US008603960B2

(12) United States Patent
Panandiker et al.

(10) Patent No.: US 8,603,960 B2
(45) **Date of Patent: *Dec. 10, 2013**

(54) FABRIC CARE COMPOSITION

(75) Inventors: Rajan Keshav Panandiker, West Chester, OH (US); Bernard William Kluesener, Harrison, OH (US); Renae Dianna Fossum, Middletown, OH (US); Heather Anne Doria, Hamilton, OH (US); Lenae Virginia Johnson, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 128 days.

This patent is subject to a terminal disclaimer.

(21) Appl. No.: 13/306,045

(22) Filed: Nov. 29, 2011

(65) Prior Publication Data

US 2012/0142578 A1 Jun. 7, 2012

Related U.S. Application Data

(60) Provisional application No. 61/418,626, filed on Dec. 1, 2010.

(51) Int. Cl.
*C11D 3/37* (2006.01)
*C11D 1/835* (2006.01)

(52) U.S. Cl.
USPC ..... 510/515

(58) Field of Classification Search
USPC ..... 510/515
See application file for complete search history.

(56) References Cited

U.S. PATENT DOCUMENTS

| | | | | |
|---|---|---|---|---|
| 4,228,277 | A * | 10/1980 | Landoll | 536/90 |
| 4,954,270 | A * | 9/1990 | Butterworth et al. | 510/522 |
| 5,498,350 | A | 3/1996 | Sakata et al. | |
| 5,726,144 | A * | 3/1998 | Dewez et al. | 510/522 |
| 6,727,220 | B1 | 4/2004 | Grainger et al. | |
| 6,815,069 | B2 | 11/2004 | Hohberg et al. | |
| 6,878,684 | B2 * | 4/2005 | Ellson et al. | 510/522 |
| 7,153,924 | B2 | 12/2006 | Kuepfer et al. | |
| 7,321,019 | B2 | 1/2008 | Ziche | |
| 7,427,648 | B2 | 9/2008 | Ochs et al. | |
| 8,183,199 | B2 | 5/2012 | Fossum et al. | |
| 2004/0076829 | A1 | 4/2004 | Levinson | |
| 2004/0204337 | A1 | 10/2004 | Corona, III et al. | |
| 2005/0245668 | A1 | 11/2005 | Green et al. | |
| 2008/0242584 | A1 | 10/2008 | Wahl et al. | |
| 2008/0305984 | A1 * | 12/2008 | Ford et al. | 510/522 |
| 2009/0042766 | A1 * | 2/2009 | Mayer et al. | 510/516 |
| 2011/0177994 | A1 | 7/2011 | Wahl et al. | |
| 2011/0239377 | A1 | 10/2011 | Fossum et al. | |
| 2012/0142578 | A1 | 6/2012 | Panandiker et al. | |
| 2012/0142579 | A1 | 6/2012 | Panandiker et al. | |

FOREIGN PATENT DOCUMENTS

| | | | |
|---|---|---|---|
| DE | 19 22 046 | A1 | 1/1971 |
| DE | 25 11 586 | B1 | 8/1976 |
| DE | 44 20 188 | A1 | 12/1995 |
| DE | 195 23 340 | C1 | 3/1996 |
| DE | 197 32 396 | A1 | 2/1999 |
| DE | 100 35 248 | A1 | 1/2002 |
| GB | 2 204 608 | A | 11/1988 |
| WO | WO 98/22088 | A1 | 5/1998 |
| WO | WO 2010/019727 | A1 | 2/2010 |

OTHER PUBLICATIONS http://www.pharmacopeia.cn/v29240/usp29nf24s0_m35484.html No date available.*

Hoover, M. Fred; Cationic Quaternary Polyelectrolytes—A Literature Review; Journal of Macromolecular Science: Part A—Chemistry: Pure and Applied Chemistry; A4(6); pp. 1327-1418; Oct. 1970.

International Search Report; International Application No. PCT/US2011/062546; date of mailing Jun. 13, 2012; 26 pages.

International Search Report; International Application No. PCT/US2011/062749; date of mailing Mar. 21, 2012; 14 pages.

Database WPI; Week 200908; Thomson Scientific, London, GB; AN 2009-B30942; XP002671115 & KR 2008 0026731 A (LG Household & Healthcare LTD) Mar. 26, 2008; abstract.

Database WPI; Week 200981; Thomson Scientific, London, GB; AN 2009-K22450; XP002671116 & KR 2009 0050288 A (SEB CO LTD); May 20, 2009; abstract.

All Office Actions, U.S. Appl. No. 13/306,045.

All Office Actions, U.S. Appl. No. 13/308,579.

* cited by examiner

*Primary Examiner* — John Hardee

(74) *Attorney, Agent, or Firm* — James F. McBride; Steven W. Miller

(57) ABSTRACT

The instant disclosure relates to compositions comprising glycerol esters. Methods of making and using such compositions are also disclosed.

18 Claims, No Drawings

FABRIC CARE COMPOSITION

CROSS-REFERENCES TO RELATED APPLICATIONS

This application claims priority under 35 U.S.C. §119(e) to U.S. Provisional Application Ser. No. 61/418,626 filed Dec. 1, 2010.

FIELD OF THE INVENTION

The instant disclosure relates to compositions comprising glycerol esters. Methods of making and using such compositions are also disclosed.

BACKGROUND OF THE INVENTION

Consumer fabric care compositions are often formulated to provide improved fabric feel, freshness, and static control. Fabric softening active in a fabric care composition may deliver softness and static control to treated fabrics, as well as delivering neat perfume to give a freshness benefit. Unfortunately, existing fabric softening actives and fabric care compositions may suffer from a variety of disadvantages. Fabric softening actives are typically very hydrophobic and must be converted from a melt into an aqueous dispersion that is pourable, disperses in rinse water, and deposits on fabric. Given the hydrophobic nature of fabric softening actives, fabric softening actives may also impart a greasy feeling to fabric. And, biodegradable fabric softening actives may suffer from chemical and physical instability, which requires formulation at a very narrow pH range. Consequently, fabric softening actives are often difficult to process and difficult to formulate into stable fabric softening compositions. The process for converting softening active into an aqueous dispersion requires high energy input and stringent process control. Fabric softening formulations sometimes require the use of additives or viscosity modifiers to stabilize the formulations, which results in higher cost and a more complicated formula. And, current fabric softening actives are often incompatible with other benefit actives, such as cationic polymers and perfumes. Finally, current fabric care compositions may be messy to use, particularly during dosing, when the composition tends to drip down the side of the dosing cap.

Thus, there is a need in the art to provide fabric care actives and compositions having improved attributes with respect to one or more of the aforementioned problems. Also, given the concern for environmentally compatible consumer products, there remains the need for fabric care agents having an improved biodegradeability profile. Finally, there is a need to provide a less messy fabric care formulation.

The use of polyhydric alcohol esters in fabric care compositions to address one or more of the needs discussed above is known. A liquid fabric softener composition containing a polyhydric alcohol ester and a cationized cellulose is also known. It has been discovered, however, that certain polyhydric alcohol esters, namely glycerol diesters, may provide additional benefits, such as better fabric feel.

SUMMARY OF THE INVENTION

The present invention provides, in one aspect of the invention, a composition comprising from about 4% to about 30%, by weight of the fabric care composition, of a mixture of glycerol esters, each having the structure of Formula I (Formula I)

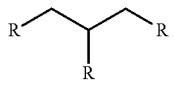

wherein each R is independently selected from the group consisting of fatty acid ester moieties comprising carbon chains having a carbon chain length of from about 10 to about 22 carbon atoms; —OH; and combinations thereof;

wherein the mixture of glycerol esters contains glycerol diester, glycerol triester, and glycerol monoester in a weight ratio of about 4:6 to about 99.9:0.1 glycerol diester to glycerol mono- and triester; and b. from about 0.01% to about 8% by weight of the fabric care composition of a delivery enhancing agent.

Other aspects of the invention include methods of making the fabric care compositions described above as well as methods of using these fabric care compositions.

DETAILED DESCRIPTION OF THE INVENTION

As used herein, the articles "a" and "an" when used in a claim, are understood to mean one or more of what is claimed or described.

As used herein, the terms "include," "includes," and "including" are meant to be non-limiting.

Glycerol esters may also be referred to as glycerides or glyceryl esters. A glycerol monester is the same as a monoglyceride and a monoacylglycerol. A glycerol diester is the same as a diglyceride or a diacylglycerol. And, a glycerol triester is the same as a triglyceride or a triacylglycerol.

The term "glycerol monoester" as used herein includes both isomers of glycerol monester and the term "glycerol diester" includes both isomers of glycerol diester. A glycerol monester molecule contains only one fatty acid residue and exists in two isomeric forms:

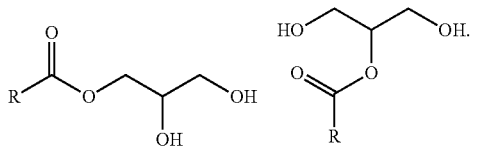

1-monoglyceride 2-monoglyceride

A glycerol diester contains two fatty acid residues and exists in two isomeric forms:

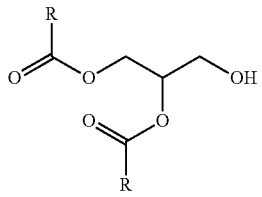

1,2-diglyceride

-continued

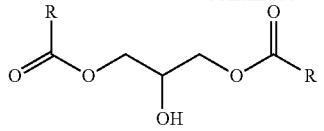

1,3-diglyceride

Unless otherwise noted, all component or composition levels are in reference to the active portion of that component or composition, and are exclusive of impurities, for example, residual solvents or by-products, which may be present in commercially available sources of such components or compositions.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Glycerol Esters

The instant disclosure relates to fabric treatment and/or care compositions comprising a mixture glycerol esters, where the mixture of glycerol esters contains glycerol diester, glycerol monoester, and glycerol triester in a weight ratio of about 4:6 to about 99.9:0.1 glycerol diester to glycerol mono- and triester. In some aspects, the ratio of glycerol diester to glycerol mono- and triester is about 4:6 to about 8:2, alternatively about 6:4 to about 9:1, alternatively about 7:3 to about 99.9:0.1, alternatively about 7:3 to about 8:2, alternatively about 6:4 to about 8:2. In some aspects, the glycerol ester component is not a mixture and comprises pure diglyceride.

The synthetic methods used to produce glycerol esters generally yield a mixture of products—glycerol, glycerol monoester, glycerol diester, and glycerol triester. Applicants have discovered that mixtures of glycerol esters comprising an increased concentration of glycerol diester, e.g., at least about 40%, have improved properties, for example, softening, formulation viscosity, biodegradability, or performance of delivery of a perfume benefit Applicants have found that glycerol monoesters, which are more soluble in water than glycerol diesters, tend to be washed away rather than deposit on fabric, in a wash or rinse cycle. Applicants have also found that glycerol triesters, which are highly hydrophobic and insoluble in water, tend to be difficult to emulsify and formulate and are less effective than glycerol diesters in regard to fabric softening. Glycerol diesters are less likely to wash away in a wash or rinse cycle and can easily be emulsified and formulated into a product for fabric softening. Without being bound to theory, it is believed that the hydroxyl groups of glycerol diester molecules hydrogen bond and assemble on fabric, thereby providing improved softening to the fabric.

Glycerol esters may be obtained by a number of known synthetic methods, including an esterification reaction and a glycerolysis reaction, which are described below. The reactions are performed under the production conditions known in the art. An acidic catalyst may be used in the esterification reaction. Acidic catalysts include sulfuric acid, hydrochloric acid, and p-toluenesulfonic acid. Esterification may also take place without a catalyst.

Esterification

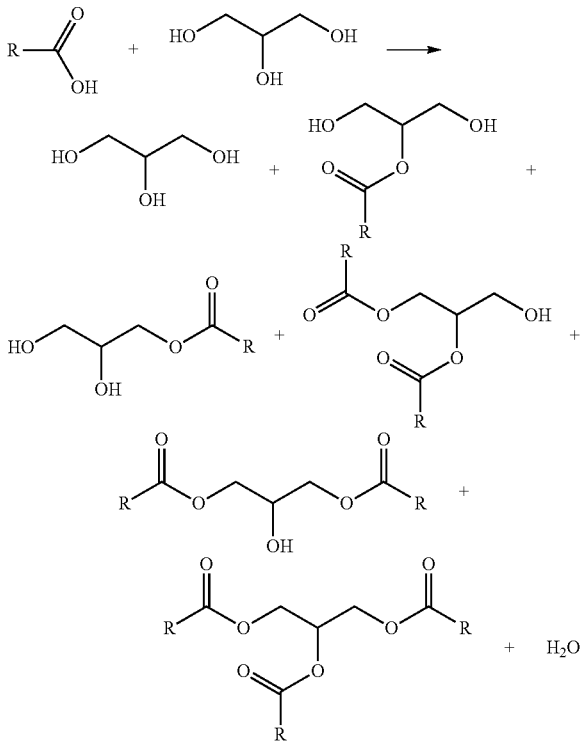

In the esterification reaction above, R is as defined above. The molar ratio of glycerol to fatty acid may be selected in such a manner that the reaction yields an increased concentration of glycerol diester, versus glycerol, glycerol monoester, and glycerol triester. For example, when using stearic acid as the fatty acid, a mole ratio of 33% glycerol and 67% stearic acid will statistically yield a mixture of glycerol, glycerol monostearate, glycerol distearate, and glycerol tristearate at a weight percent ratio of 0.5%:12.5%:44.2%:42.8%.

In addition to glycerol, other polyhydric alcohols may also be used in the esterification reaction to yield various polyhydric alcohol esters. For example, erythritol, pentaerythritol, sorbitol, or sorbitan may be used. These polyhydric alcohols may be used either alone or in the form of a mixture of at least two of them.

Examples of the fatty acids to be used in the above method include capric acid, lauric acid, myristic acid, palmitic acid, oleic acid, stearic acid, isostearic acid, arachidic acid and behenic acid; and fatty acids obtained from unhardened or hardened animal fats (for example, beef tallow and lard), palm oil, rapeseed oil and fish oil. These fatty acids may be used either alone or in the form of a mixture of at least two of them.

Glycerolysis/Transesterification

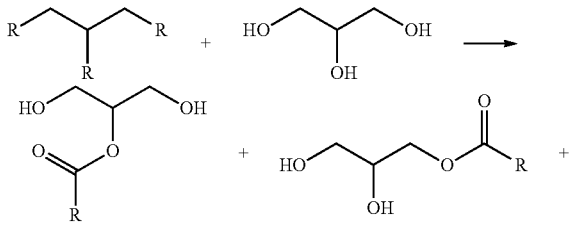

-continued

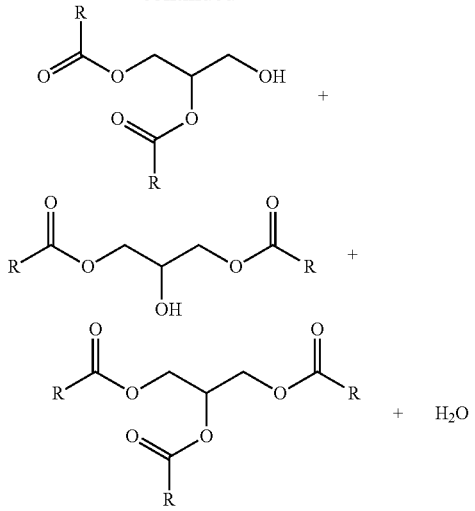

In the glycerolysis/transesterification reaction above, R is as defined above. In the reaction, glycerol triester, glycerol diester, and/or glycerol monoester is reacted with glycerol. Various basic catalysts may be used in the glycerolysis/transesterification reaction, including NaOH, KOH, $NaOCH_3$, $KOCH_3$ or the like. Acid catalysts may also be used. As with the esterification reaction described above, the molar ratio of the reactants in the glycerolysis/transesterification reaction may be selected in such a manner that the reaction yields an increased concentration of glycerol diester, versus glycerol, glycerol monoester, and glycerol triester.

In addition to glycerol monoester, glycerol diester, glycerol triester, and glycerol, other fatty acid esters and other polyhydric alcohols may be used to yield various polyhydric alcohol esters. Examples of the fatty acid esters that can be used in the glycerolysis/transesterification reaction include esters of methanol, ethanol, propanol, butanol, ethylene glycol, erythritol, pentaerythritol, xylitol, sorbitol and sorbitan with the fatty acids described above in the esterification reaction. Examples of other polyhydric alcohols are also described above the esterification reaction.

Other synthetic methods for making glycerol esters are known, including an interesterification reaction. Additional synthetic methods used to produce glycerol esters and other polyhydric alcohol esters are disclosed in U.S. Pat. No. 5,498,350, which is hereby incorporated by reference.

Furthermore, there are additional methods of increasing the yield of glycerol diester, versus glycerol, glycerol monoester, and glycerol triester. As noted above, the molar ratio of the reactants in the above-described reactions may be selected in such a manner that the reaction yields an increased concentration of glycerol diester, versus glycerol, glycerol monoester, and glycerol triester. Additionally, a diglyceride-enriched product may be produced via distillation, crystallization, solvent extraction, or chromatography of reaction products. Specialized catalysts, e.g., lipase, may also be used to produce a diglyceride-enriched product. Finally, a diglyceride-enriched product may be produced through careful control of reaction conditions, e.g., temperature, mole ratio, time, mixing conditions, and the use of parallel processes such as distillation, in any of the synthesis methods used to produce glycerol ester.

In one aspect, the fabric softening composition may comprise, based on total weight of the composition, from about 2% to about 50%, or from about 4% to about 40%, or from about 4% to about 30%, or from about 4% to about 20%, alternatively about 4% to about 10%, alternatively about 5% to about 8% of a mixture of glycerol esters.

In some aspects, the mixture of glycerol esters may be emulsified, for example, in cetyl trimethylammonium chloride and/or a nonionic surfactant.

Delivery Enhancing Agent

The compositions may comprise a "delivery enhancing agent." As used herein, such term refers to any polymer or combination of polymers that significantly enhance the deposition of the fabric care benefit agent onto the fabric during laundering. In one aspect, the fabric treatment composition may comprise from about 0.01% to about 10%, from about 0.05 to about 5%, or from about 0.15 to about 3% of a deposition aid. Suitable deposition aids are disclosed in, for example, the U.S. publication of patent application Ser. No. 12/080,358.

Applicants have discovered that the glycerol esters of the invention may advantageously be combined with enzyme-compatible delivery enhancing agents. Certain delivery enhancing agents, e.g., polyquaternium-10, are not compatible with certain enzymes.

In order to drive the fabric care benefit agent onto the fabric, the net charge of the delivery enhancing agent is preferably positive in order to overcome the repulsion between the fabric care benefit agent and the fabric since most fabrics are comprised of textile fibers that have a slightly negative charge in aqueous environments. Examples of fibers exhibiting a slightly negative charge in water include but are not limited to cotton, rayon, silk, wool, etc.

Preferably, the delivery enhancing agent is a cationic or amphoteric polymer. The amphoteric polymers of the present invention will also have a net cationic charge, i.e. the total cationic charges on these polymers will exceed the total anionic charge. The cationic charge density of the polymer ranges from about 0.05 milliequivalents/g to about 23 milliequivalents/g. The charge density is calculated by dividing the number of net charge per repeating unit by the molecular weight of the repeating unit. In one embodiment, the charge density varies from about 0.05 milliequivants/g to about 8 milliequivalents/g. The positive charges could be on the backbone of the polymers or the side chains of polymers.

Nonlimiting examples of deposition enhancing agents are cationic or amphoteric polysaccharides, proteins and synthetic polymers.

a. Cationic Polysaccharides:

Cationic polysaccharides include but not limited to cationic cellulose derivatives, cationic guar gum derivatives, chitosan and derivatives and cationic starches. Cationic polysacchrides have a molecular weight from about 50,000 to about 2 million, preferably from about 100,000 to about 1,500,000.

One group of preferred cationic polysaccharides is shown below:

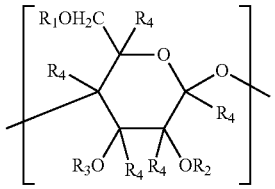

wherein $R^1$, $R^2$, $R^3$ are each independently H, $C_{1-24}$ alkyl (linear or branched),

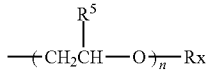

wherein n is from about 0 to about 10; Rx is H, $C_{1-24}$ alkyl (linear or branched) or

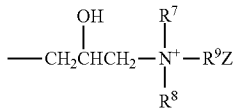

or mixtures thereof, wherein Z is a water soluble anion, preferably chloride, bromide iodide, hydroxide, phosphate sulfate, methyl sulfate and acetate; $R^5$ is selected from H, or $C_1$-$C_6$ alkyl or mixtures thereof; $R^7$, $R^8$ and $R^9$ are selected from H, or $C_1$-$C_{28}$ alkyl, benzyl or substituted benzyl or mixtures thereof $R^4$ is II or —$(P)_m$-II, or mixtures thereof; wherein P is a repeat unit of an addition polymer formed by a cationic monomer. In one embodiment, the cationic monomer is selected from methacrylamidotrimethylammonium chloride, dimethyl diallyl ammonium having the formula:

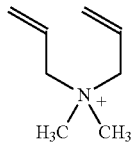

which results in a polymer or co-polymer having units with the formula:

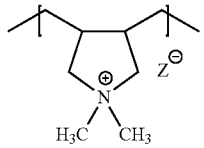

wherein Z' is a water-soluble anion, preferably chloride, bromide iodide, hydroxide, phosphate sulfate, methyl sulfate and acetate or mixtures thereof and m is from about 1 to about 100. Alkyl substitution on the saccharide rings of the polymer ranges from about 0.01% to 5% per sugar unit, more preferably from about 0.05% to 2% per glucose unit, of the polymeric material.

Preferred cationic polysaccahides include cationic hydroxyalkyl celluloses. Examples of cationic hydroxyalkyl cellulose include those with the INCI name Polyquaternium 10 such as those sold under the trade names Ucare Polymer JR 30M, JR 400, JR 125, LR 400 and LK 400 polymers; Polyquaternium 67 sold under the trade name Softcat SK™, all of which are marketed by Amerchol Corporation Edgewater N.J.; and Polyquaternium 4 sold under the trade name Celquat H200 and Celquat L-200 available from National Starch and Chemical Company, Bridgewater, N.J. Other preferred polysaccharides include hydroxyethyl cellulose or hydoxypropylcellulose quaternized with glycidyl $C_{12}$-$C_{22}$ alkyl dimethyl ammonium chloride. Examples of such polysaccahrides include the polymers with the INCI names Polyquaternium 24 sold under the trade name Quaternium LM 200, PG-Hydroxyethylcellulose Lauryldimonium Chloride sold under the trade name Crodacel LM, PG-Hydroxyethylcellulose Cocodimonium Chloride sold under the trade name Crodacel QM and, PG-Hydroxyethylcellulose stearyldimonium Chloride sold under the trade name Crodacel QS and alkyldimethylammonium hydroxypropyl oxyethyl cellulose.

In one embodiment of the present invention, the cationic polymer comprises cationic starch. These are described by D. B. Solarek in Modified Starches, Properties and Uses published by CRC Press (1986) and in U.S. Pat. No. 7,135,451, col. 2, line 33-col. 4, line 67. In another embodiment, the cationic starch of the present invention comprises amylose at a level of from about 0% to about 70% by weight of the cationic starch. In yet another embodiment, when the cationic starch comprises cationic maize starch, said cationic starch comprises from about 25% to about 30% amylose, by weight of the cationic starch. The remaining polymer in the above embodiments comprises amylopectin.

A third group of preferred polysaccahrides are cationic galactomanans, such as cationic guar gums or cationic locust bean gum. Example of cationic guar gum is a quaternary ammonium derivative of Hydroxypropyl Guar sold under the trade name Jaguar C13 and Jaguar Excel available from Rhodia, Inc of Cranburry N.J. and N-Hance by Aqualon, Wilmington, Del.

b. Synthetic Cationic Polymers

Cationic polymers in general and their method of manufacture are known in the literature. For example, a detailed description of cationic polymers can be found in an article by M. Fred Hoover that was published in the *Journal of Macromolecular Science-Chemistry*, A4(6), pp 1327-1417, October, 1970. The entire disclosure of the Hoover article is incorporated herein by reference. Other suitable cationic polymers are those used as retention aids in the manufacture of paper. They are described in "Pulp and Paper, Chemistry and Chemical Technology Volume III edited by James Casey (1981). The Molecular weight of these polymers is in the range of 2000-5 million. The synthetic cationic polymers of this invention will be better understood when read in light of the Hoover article and the Casey book, the present disclosure and the Examples herein.

i. Addition Polymers

Synthetic polymers include but are not limited to synthetic addition polymers of the general structure

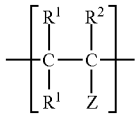

wherein $R^1$, $R^2$, and Z are defined herein below. Preferably, the linear polymer units are formed from linearly polymerizing monomers. Linearly polymerizing monomers are defined herein as monomers which under standard polymerizing conditions result in a linear or branched polymer chain or alternatively which linearly propagate polymerization. The linearly polymerizing monomers of the present invention have the formula:

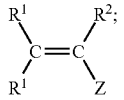

however, those of skill in the art recognize that many useful linear monomer units are introduced indirectly, inter alia, vinyl amine units, vinyl alcohol units, and not by way of linearly polymerizing monomers. For example, vinyl acetate monomers once incorporated into the backbone are hydrolyzed to form vinyl alcohol units. For the purposes of the present invention, linear polymer units may be directly introduced, i.e. via linearly polymerizing units, or indirectly, i.e. via a precursor as in the case of vinyl alcohol cited herein above.

Each $R^1$ is independently hydrogen, $C_1$-$C_{12}$ alkyl, substituted or unsubstituted phenyl, substituted or unsubstituted benzyl, —$OR_a$, or —$C(O)OR_a$ wherein $R_a$ is selected from hydrogen, and $C_1$-$C_{24}$ alkyl and mixtures thereof. Preferably $R^1$ is hydrogen, $C_1$-$C_4$ alkyl, or —$OR_a$, or —$C(O)OR_a$ Each $R^2$ is independently hydrogen, hydroxyl, halogen, $C_1$-$C_{12}$ alkyl, —$OR_a$, substituted or unsubstituted phenyl, substituted or unsubstituted benzyl, carbocyclic, heterocyclic, and mixtures thereof. Preferred $R^2$ is hydrogen, $C_1$-$C_4$ alkyl, and mixtures thereof.

Each Z is independently hydrogen, halogen; linear or branched C1-C30 alkyl, nitrilo, $N(R_3)_2$—$C(O)N(R_3)_2$; —NHCHO (formamide); —$OR^3$, —$O(CH_2)_nN(R^3)_2$, —$O(CH_2)_nN^+(R^3)_3X^-$, –$C(O)OR^4$; —$C(O)N$—$(R^3)_2$—$C(O)O(CH_2)_nN(R^3)_2$, —$C(O)O(CH_2)_nN^+(R^3)_3X^-$, —$OCO(CH_2)_nN^+(R^3)_3X^-$, —$C(O)NH$—$(CH_2)_nN(R^3)_2$, —$C(O)NH(CH_2)_nN^+(R^3)_3X^-$, —$(CH_2)_nN(R^3)_2$, —$(CH_2)_n(R^3)_3X^-$, each $R_3$ is independently hydrogen, $C_1$-$C_{24}$ alkyl, $C_2$-$C_8$ hydroxyalkyl, benzyl; substituted benzyl and mixtures thereof;

each $R_4$ is independently hydrogen or $C_1$-$C_{24}$ alkyl, and

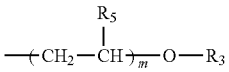

X is a water soluble anion; the index n is from 1 to 6.

$R_5$ is independently hydrogen, $C_1$-$C_6$ alkyl, and mixtures thereof

Z can also be selected from non-aromatic nitrogen heterocycle comprising a quaternary ammonium ion, heterocycle comprising an N-oxide moiety, an aromatic nitrogen containing heterocyclic wherein one or more or the nitrogen atoms is quaternized; an aromatic nitrogen containing heterocycle wherein at least one nitrogen is an N-oxide; or mixtures thereof. Non-limiting examples of addition polymerizing monomers comprising a heterocyclic Z unit includes 1-vinyl-2-pyrrolidinone, 1-vinyl imidazole, quaternized vinyl imidazole, 2-vinyl-1,3-dioxolane, 4-vinyl-1-cyclohexene1,2-epoxide, and 2-vinylpyridine, 2-vinylpyridine N-oxide, 4-vinylpyridine 4-vinylpyridine N-oxide.

A non-limiting example of a Z unit which can be made to form a cationic charge in situ is the —NHCHO unit, formamide. The formulator can prepare a polymer or co-polymer comprising formamide units some of which are subsequently hydrolyzed to form vinyl amine equivalents.

The polymers and co-polymers of the present invention comprise Z units which have a cationic charge or which result in a unit which forms a cationic charge in situ. When the co-polymers of the present invention comprise more than one Z unit, for example, $Z^1$, $Z^2$, . . . $Z^n$ units, at least about 1% of the monomers which comprise the co-polymers will comprise a cationic unit.

The polymers or co-polymers of the present invention can comprise one or more cyclic polymer units which are derived from cyclically polymerizing monomers. Cyclically polymerizing monomers are defined herein as monomers which under standard polymerizing conditions result in a cyclic polymer residue as well as serving to linearly propagate polymerization. Preferred cyclically polymerizing monomers of the present invention have the formula:

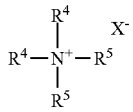

wherein each $R^4$ is independently an olefin comprising unit which is capable of propagating polymerization in addition to forming a cyclic residue with an adjacent $R^4$ unit; $R^5$ is $C_1$-$C_{12}$ linear or branched alkyl, benzyl, substituted benzyl, and mixtures thereof; X is a water soluble anion.

Non-limiting examples of $R^4$ units include allyl and alkyl substituted allyl units. Preferably the resulting cyclic residue is a six-member ring comprising a quaternary nitrogen atom.

$R^5$ is preferably $C_1$-$C_4$ alkyl, preferably methyl.

An example of a cyclically polymerizing monomer is dimethyl diallyl ammonium having the formula:

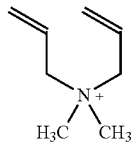

which results in a polymer or co-polymer having units with the formula:

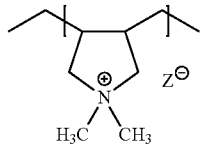

wherein preferably the index z is from about 10 to about 50,000.

Nonlimiting examples of preferred polymers according to the present invention include copolymers made from one or more cationic monomers selected from the group consisting a) N,N-dialkylaminoalkyl methacrylate, N,N-dialkylaminoalkyl acrylate, N,N-dialkylaminoalkyl acrylamide, N,N-dialkylaminoalkylmethacrylamide, quaternized N,N-dialkylaminoalkyl methacrylate, quaternized N,N-dialkylaminoalkyl acrylate, quaternized N,N-dialkylaminoalkyl acrylamide, quaternized N,N-dialkylaminoalkylmethacrylamide b) vinylamine and its derivatives, allylamine and its derivatives, c) vinyl imidazole, quaternized vinyl imidazole and diallyl dialkyl ammonium chloride.

And optionally a second monomer selected from a group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole and derivatives, acrylic acid, methacrylic acid, maleic acid, vinyl sulfonic acid, styrene sulfonic acid, acrylamidopropylmethane sulfonic acid (AMPS) and their salts The polymer may optionally be cross-linked. Crosslinking monomers include, but are not limited to, ethylene glycoldiacrylatate, divinylbenzene, butadiene.

Preferred cationic monomers include N,N-dimethyl aminoethyl acrylate, N,N-dimethyl aminoethyl methacrylate (DMAM), [2-(methacryloylamino)ethyl]tri-methylammonium chloride (QDMAM), N,N-dimethylaminopropyl acrylamide (DMAPA), N,N-dimethylaminopropyl methacrylamide (DMAPMA), acrylamidopropyl trimethyl ammonium chloride, methacrylamidopropyl trimethylammonium chloride (MAPTAC), quaternized vinyl imidazole and diallyldimethylammonium chloride and derivatives thereof.

Preferred second monomers include acrylamide, N,N-dimethyl acrylamide, C1-C4 alkyl acrylate, C1-C4 hydroxyalkylacrylate, vinyl formamide, vinyl acetate, and vinyl alcohol. Most preferred nonionic monomers are acrylamide, hydroxyethyl acrylate (HEA), hydroxypropyl acrylate and derivative thereof, The most preferred synthetic polymers are poly(acrylamide-co-diallyldimethylammonium chloride), poly(acrylamide-methacrylamidopropyltrimethyl ammonium chloride), poly(acrylamide-co-N,N-dimethyl aminoethyl methacrylate), poly(acrylamide-co-N,N-dimethyl aminoethyl methacrylate), poly(hydroxyethylacrylate-co-dimethyl aminoethyl methacrylate), poly(hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid), ii. Polyethyleneimine and its Derivatives These are commercially available under the trade name Lupasol ex. BASF AG of Ludwigschaefen, Germany. In one embodiment, the polyethylene derivative is an amide derivative of polyetheyleneimine sold under the trade name Lupoasol SK. Also included are alkoxylated polyethleneimine; alkyl polyethyleneimine and quaternized polyethyleneimine.

iii. Polyamidoamine-epichlorohydrin (PAE) Resins

PAE resins are condensation products of polyalkylenepolyamine with polycarboxyic acid. The most common PAE resins are the condensation products of diethylenetriamine with adipic acid followed by a subsequent reaction with epichlorohydrin. They are available from Hercules Inc. of Wilmington Del. under the trade name Kymene or from BASF A.G. under the trade name Luresin. These polymers are described in Wet Strength resins and their applications edited by L. L. Chan, TAPPI Press (1994).

The deposition assisting polymer has a charge density of about 0.01 to about 23.0 milliequivalents/g (meq/g) of dry polymer, preferably about 0.05 to about 8 meq/g. For polymers with amine monomers, the charge density depends on the pH of the carrier. For these polymers, charge density is measured at a pH of 7.

The weight-average molecular weight of the polymer will generally be between 10,000 and 5,000,000, preferably from 100,000 to 2,000,000 and even more preferably from 200,000 and 1,500,000, as determined by size exclusion chromatography relative to polyethyleneoxide standards with RI detection. The mobile phase used is a solution of 20% methanol in 0.4M MEA, 0.1 M $NaNO_3$, 3% acetic acid on a Waters Linear Ultrandyrogel column, 2 in series. Columns and detectors are kept at 40° C. Flow is set to 0.5 mL/min.

In another aspect, the delivery enhancing agent may comprise at least one polymer formed from the polymerisation of a) a water soluble ethylenically unsaturated monomer or blend of monomers comprising at least one cationic monomer and at least one non-ionic monomer;

wherein the cationic monomer is a compound according to formula (I):

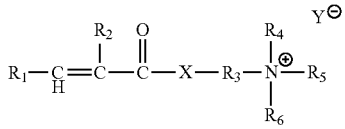

(I)

wherein:

$R_1$ is chosen from hydrogen or methyl, preferably hydrogen;

$R_2$ is chosen hydrogen, or $C_1$-$C_4$ alkyl, preferably hydrogen;

$R_3$ is chosen $C_1$-$C_4$ alkylene, preferably ethylene;

$R_4$, $R_5$, and $R_6$ are each independently chosen from hydrogen, or $C_1$-$C_4$ alkyl, preferably methyl;

X is chosen from —O—, or —NH—, preferably —O—; and

Y is chosen from Cl, Br, I, hydrogensulfate, or methosulfate, preferably Cl.

wherein the non-ionic monomer is a compound of formula (II):

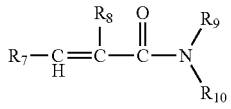

(II)

wherein:

$R_7$ is chosen from hydrogen or methyl, preferably hydrogen;

$R_8$ is chosen from hydrogen or $C_1$-$C_4$ alkyl, preferably hydrogen; and $R_9$ and $R_{10}$ are each independently chosen from hydrogen or $C_1$-$C_4$ alkyl, preferably methyl, b) at least one cross-linking agent in an amount from 0.5 ppm to 1000 ppm by the weight of component a), and c) at least one chain transfer agent in the amount of greater than 10 ppm relative to component a), preferably from 1200 ppm to 10,000 ppm, more preferably from 1,500 ppm to 3,000 ppm (as described in the U.S. Patent Application claiming the benefit of Provisional Application No. 61/320,032).

Other Components

The disclosed compositions may include additional components. The following is a non-limiting list of suitable additional components.

Fabric Softener Active

Liquid fabric care compositions, e.g., fabric softening compositions (such as those contained in DOWNY or LENOR), comprise a fabric softening active. One class of fabric softener actives includes cationic surfactants.

Examples of cationic surfactants include quaternary ammonium compounds. Exemplary quaternary ammonium compounds include alkylated quaternary ammonium compounds, ring or cyclic quaternary ammonium compounds, aromatic quaternary ammonium compounds, diquaternary ammonium compounds, alkoxylated quaternary ammonium compounds, amidoamine quaternary ammonium compounds, ester quaternary ammonium compounds, and mixtures thereof. A final fabric softening composition (suitable for retail sale) will comprise from about 1.5% to about 50%, alternatively from about 1.5% to about 30%, alternatively from about 3% to about 25%, alternatively from about 3 to about 15%, of fabric softening active by weight of the final composition. Fabric softening compositions, and components thereof, are generally described in US 2004/0204337. In one embodiment, the fabric softening composition is a so called rinse added composition. In such an embodiment, the composition is substantially free of detersive surfactants, alternatively substantially free of anionic surfactants. In another embodiment, the pH of the fabric softening composition is acidic, for example between about pH 2 and about pH 5, alternatively between about pH 2 to about pH 4, alternatively between about pH 2 and about pH 3. The pH may be adjusted with the use of hydrochloric acid or formic acid.

In yet another embodiment, the fabric softening active is DEEDMAC (e.g., ditallowoyl ethanolester dimethyl ammonium chloride). DEEDMAC means mono and di-fatty acid ethanol ester dimethyl ammonium quaternaries, the reaction products of straight chain fatty acids, methyl esters and/or triglycerides (e.g., from animal and/or vegetable fats and oils such as tallow, palm oil and the like) and methyl diethanol amine to form the mono and di-ester compounds followed by quaternization with an alkylating agent.

In one aspect, the fabric softener active is a bis-(2-hydroxyethyl)-dimethylammonium chloride fatty acid ester having an average chain length of the fatty acid moieties of from 16 to 20 carbon atoms, preferably 16 to 18 carbon atoms, and an Iodine Value (IV), calculated for the free fatty acid, of from 15 to 25, alternatively from 18 to 22, alternatively from about 19 to about 21, alternatively combinations thereof. The Iodine Value is the amount of iodine in grams consumed by the reaction of the double bonds of 100 g of fatty acid, determined by the method of ISO 3961.

In certain aspects, the fabric softening active comprises a compound of formula (I):

(Formula (I))

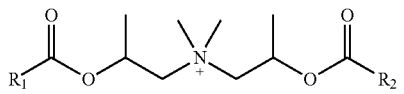

Anion wherein $R_1$ and $R_2$ is each independently a $C_{15}$-$C_{17}$, and wherein the $C_{15}$-$C_{17}$ is unsaturated or saturated, branched or linear, substituted or unsubstituted. This fabric softening active is further described in the publication of U.S. patent application Ser. No. 12/752,209

In some aspects, the fabric softening active comprises a bis-(2-hydroxypropyl)-dimethylammonium methylsulphate fatty acid ester having a molar ratio of fatty acid moieties to amine moieties of from 1.85 to 1.99, an average chain length of the fatty acid moieties of from 16 to 18 carbon atoms and an iodine value of the fatty acid moieties, calculated for the free fatty acid, of from 0.5 to 60. This fabric softening active is further described in the publication of U.S. patent application Ser. No. 12/752,220.

In some aspects, the fabric softening active comprises, as the principal active, compounds of the formula $$\{R_{4-m}—N^+—[(CH_2)_n—Y—R^1]_m\}A^- \quad (1)$$

wherein each R substituent is either hydrogen, a short chain $C_1$-$C_6$, preferably $C_1$-$C_3$ alkyl or hydroxyalkyl group, e.g., methyl, ethyl, propyl, hydroxyethyl, and the like, poly($C_{2-3}$ alkoxy), preferably polyethoxy, benzyl, or mixtures thereof; each m is 2 or 3; each n is from 1 to about 4, preferably 2; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$-$C_{22}$, preferably $C_{14}$-$C_{20}$, with each $R^1$ being a hydrocarbyl, or substituted hydrocarbyl group, and $A^-$ can be any softener-compatible anion, preferably, chloride, bromide, methylsulfate, ethylsulfate, sulfate, and nitrate, more preferably chloride or methyl sulfate;

In some aspects, the fabric softening active has the general formula:

$$[R_3N^+CH_2CH(YR^1)(CH_2YR^1)]A^-$$

wherein each Y, R, $R^1$, and $A^-$ have the same meanings as before. Such compounds include those having the formula:

$$[CH_3]_3N^{(+)}[CH_2CH(CH_2O(O)CR^1)O(O)CR^1]Cl^{(-)} \quad (2)$$

wherein each R is a methyl or ethyl group and preferably each $R^1$ is in the range of $C_{15}$ to $C_{19}$. As used herein, when the diester is specified, it can include the monoester that is present.

These types of agents and general methods of making them are disclosed in U.S. Pat. No. 4,137,180, Naik et al., issued Jan. 30, 1979, which is incorporated herein by reference. An example of a preferred DEQA (2) is the "propyl" ester quaternary ammonium fabric softener active having the formula 1,2-di(acyloxy)-3-trimethylammoniopropane chloride.

In some aspects, the fabric softening active has the formula:

$$[R_{4-m}—N^+—R^1_m]A^- \quad (3)$$

wherein each R, $R^1$, and $A^-$ have the same meanings as before.

In some aspects, the fabric softening active has the formula:

(4)

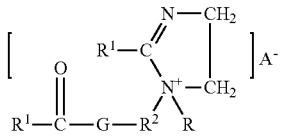

wherein each R, $R^1$, and $A^-$ have the definitions given above; each $R^2$ is a $C_{1-6}$ alkylene group, preferably an ethylene group; and G is an oxygen atom or an —NR— group;

In some aspects, the fabric softening active has the formula:

(5)

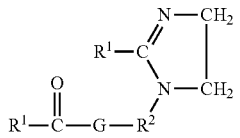

wherein $R^1$, $R^2$ and G are defined as above.

In some aspects, the fabric softening active is a condensation reaction product of fatty acids with dialkylenetriamines in, e.g., a molecular ratio of about 2:1, said reaction products containing compounds of the formula:

$$R^1—C(O)—NH—R^2—NH—R^3—NH—C(O)—R^1 \quad (6)$$

wherein $R^1$, $R^2$ are defined as above, and each $R^3$ is a $C_{1-6}$ alkylene group, preferably an ethylene group and wherein the reaction products may optionally be quaternized by the additional of an alkylating agent such as dimethyl sulfate. Such quaternized reaction products are described in additional detail in U.S. Pat. No. 5,296,622, issued Mar. 22, 1994 to Uphues et al., which is incorporated herein by reference;

In some aspects, the preferred fabric softening active has the formula:

$$[R^1—C(O)—NR—R^2—N(R)_2—R^3—NR—C(O)—R^1]^+A^- \quad (7)$$

wherein R, $R^1$, $R^2$, $R^3$ and $A^-$ are defined as above;

In some aspects, the fabric softening active is a reaction product of fatty acid with hydroxyalkylalkylenediamines in a molecular ratio of about 2:1, said reaction products containing compounds of the formula:

$$R^1—C(O)—NR—R^2—N(R^3OH)—C(O)—R^1 \quad (8)$$

wherein $R^1$, $R^2$ and $R^3$ are defined as above;

In some aspects, the fabric softening active has the formula:

(9)

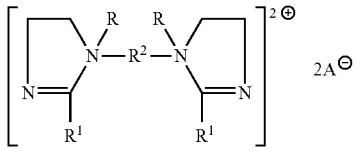

wherein R, $R^1$, $R^2$, and $A^-$ are defined as above.

Non-limiting examples of compound (1) are N,N-bis(stearoyl-oxy-ethyl)N,N-dimethyl ammonium chloride, N,N-bis(tallowoyl-oxy-ethyl)N,N-dimethyl ammonium chloride, N,N-bis(stearoyl-oxy-ethyl) N-(2 hydroxyethyl)N-methyl ammonium methylsulfate.

Non-limiting examples of compound (2) is 1,2 di(stearoyl-oxy) 3 trimethyl ammoniumpropane chloride.

Non-limiting examples of Compound (3) are dialkylenedimethylammonium salts such as dicanoladimethylammonium chloride, di(hard)tallowdimethylammonium chloride dicanoladimethylammonium methylsulfate,. An example of commercially available dialkylenedimethylammonium salts usable in the present invention is dioleyldimethylammonium chloride available from the Evonik Corporation under the trade name Adogen® 472 and dihardtallow dimethylammonium chloride available from Akzo Nobel Arquad 2HT75.

A non-limiting example of Compound (4) is 1-methyl-1-stearoylamidoethyl-2-stearoylimidazolinium methylsulfate wherein $R^1$ is an acyclic aliphatic $C_{15}$-$C_{17}$ hydrocarbon group, $R^2$ is an ethylene group, G is a NH group, $R^5$ is a methyl group and $A^-$ is a methyl sulfate anion, available commercially from the Witco Corporation under the trade name Varisoft®.

A non-limiting example of Compound (5) is 1-tallowylamidoethyl-2-tallowylimidazoline wherein $R^1$ is an acyclic aliphatic $C_{15}$-$C_{17}$ hydrocarbon group, $R^2$ is an ethylene group, and G is a NH group.

A non-limiting example of Compound (6) is the reaction products of fatty acids with diethylenetriamine in a molecular ratio of about 2:1, said reaction product mixture containing N,N"-dialkyldiethylenetriamine with the formula:

$$R^1—C(O)—NH—CH_2CH_2—NH—CH_2CH_2—NH—C(O)—R^1$$

wherein $R^1$—C(O) is an alkyl group of a commercially available fatty acid derived from a vegetable or animal source, such as Emersol® 223LL or Emersol® 7021, available from Henkel Corporation, and $R^2$ and $R^3$ are divalent ethylene groups.

A non-limiting example of Compound (7) is a difatty amidoamine based softener having the formula:

$$[R^1—C(O)—NH—CH_2CH_2—N(CH_3)(CH_2CH_2OH)—CH_2CH_2—NH—C(O)—R^1]^+ CH_3SO_4^-$$

wherein $R^1$—C(O) is an alkyl group, available commercially from the Witco Corporation e.g.

under the trade name Varisoft 222LT.

An example of Compound (8) is the reaction products of fatty acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is an alkyl group of a commercially available fatty acid derived from a vegetable or animal source, such as Emersol® 223LL or Emersol® 7021, available from Henkel Corporation.

An example of Compound (9) is the diquaternary compound having the formula:

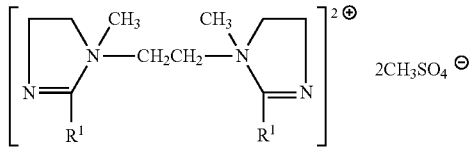

wherein $R^1$ is derived from fatty acid, and the compound is available from Witco Company.

It will be understood that combinations of softener actives disclosed above are suitable for use in this invention.

In the cationic nitrogenous salts herein, the anion $A^-$, which is any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. Chloride and methylsulfate are preferred herein as anion A. The anion can also, but less preferably, carry a double charge in which case $A^-$ represents half a group.

Silicones

One aspect of the invention provides for fabric care compositions comprising a silicone. The term silicone is used herein in the broadest sense to include a silicone or silicone comprising compound that imparts a desirable benefit to fabric (upon using a fabric care composition of the present invention). "Silicone" preferably refers to emulsified and/or microemulsified silicones, including those that are commercially available and those that are emulsified and/or microemulsified in the composition, unless otherwise described.

In one embodiment, the silicone is a polydialkylsilicone, alternatively a polydimethyl silicone (polydimethyl siloxane or "PDMS"), or a derivative thereof. In another embodiment, the silicone is chosen from an aminofunctional silicone, alkyloxylated silicone, ethoxylated silicone, propoxylated silicone, ethoxylated/propoxylated silicone, quaternary silicone, or combinations thereof. Levels of silicone in the fabric care composition may include from about 0.01% to about 20%, alternatively from about 0.1% to about 10%, alternatively from about 0.25% to about 5%, alternatively from about 0.4% to about 3%, alternatively from about 1% to about 5%, alternatively from about 1% to about 4%, alternatively from about 2% to about 3%, by weight of the fabric care composition.

Some non-limiting examples of silicones that are useful in the present invention include aminofunctional silicones as disclosed in the US application claiming the benefit of Provisional Application No. 61/221,670.

Some non-limiting examples of silicones that are useful in the present invention are: non-volatile silicone fluids such as polydimethyl siloxane gums and fluids; volatile silicone fluid which can be a cyclic silicone fluid of the formula $[(CH_3)_2SiO]_n$ where n ranges between about 3 to about 7, preferably about 5, or a linear silicone polymer fluid having the formula $(CH_3)_3SiO[(CH_3)_2SiO]_m Si(CH_3)_3$ where m can be 0 or greater and has an average value such that the viscosity at 25° C. of the silicone fluid is preferably about 5 centistokes or less.

One type of silicone that may be useful in the composition of the present invention is polyalkyl silicone with the following structure:

$$A\text{-}(SI(R_2)\text{—}O\text{—}[Si(R_2)\text{—}O\text{—}]_q\text{—}Si(R_2)\text{-}A$$

The alkyl groups substituted on the siloxane chain (R) or at the ends of the siloxane chains (A) can have any structure as long as the resulting silicones remain fluid at room temperature.

Each R group preferably is alkyl, hydroxy, or hydroxyalkyl group, and mixtures thereof, having less than about 8, preferably less than about 6 carbon atoms, more preferably, each R group is methyl, ethyl, propyl, hydroxy group, and mixtures thereof. Most preferably, each R group is methyl. Aryl, alkylaryl and/or arylalkyl groups are not preferred. Each A group which blocks the ends of the silicone chain is hydrogen, methyl, methoxy, ethoxy, hydroxy, propoxy, and mixtures thereof, preferably methyl. q is preferably an integer from about 7 to about 8,000.

One type of silicones include polydimethyl siloxanes and preferably those polydimethyl siloxanes having a viscosity of from about 10 to about 1000,000 centistokes at 25° C. Mixtures of volatile silicones and non-volatile polydimethyl siloxanes are also preferred. Preferably, the silicones are hydrophobic, non-irritating, non-toxic, and not otherwise harmful when applied to fabric or when they come in contact with human skin. Further, the silicones are compatible with other components of the composition are chemically stable under normal use and storage conditions and are capable of being deposited on fabric.

Other useful silicone materials, may include materials of the formula:

$$HO\text{—}[Si(CH_3)_2\text{—}O]_x\text{—}\{Si(OH)[(CH_2)_3\text{—}NH\text{—}(CH_2)_2\text{—}NH_2]O\}_y\text{—}H$$

wherein x and y are integers which depend on the molecular weight of the silicone, preferably having a viscosity of from about 10,000 cst to about 500,000 cst at 25° C. This material is also known as "amodimethicone". Although silicones with a high number, e.g., greater than about 0.5 millimolar equivalent of amine groups can be used, they are not preferred because they can cause fabric yellowing.

Similarly, silicone materials which may be used correspond to the formulas:

$$(R^1)_aG_{3-a}\text{-}Si\text{—}(\text{—}OSiG_2)_n\text{-}(OSiG_b(R^1)_{2-b})_m\text{—}O\text{—}SiG_{3-a}(R^1)_a$$

wherein G is selected from the group consisting of hydrogen, OH, and/or $C_1$-$C_5$ alkyl; a denotes 0 or an integer from 1 to 3; b denotes 0 or 1; the sum of n+m is a number from 1 to about 2,000; $R^1$ is a monovalent radical of formula $CpH_{2p}L$ in which p is an integer from 2 to 4 and L is selected from the group consisting of:

a) $\text{—}N(R^2)CH_2\text{—}CH_2\text{—}N(R^2)_2$;

b) $\text{—}N(R^2)_2$;

c) $\text{—}N+(R^2)_3\ A^-$; and d) $\text{—}N+(R^2)CH_2\text{—}CH_2N+H_2A^-$ wherein each $R^2$ is chosen from the group consisting of hydrogen, a $C_1$-$C_5$ saturated hydrocarbon radical, and each $A^-$ denotes compatible anion, e.g., a halide ion; and $$R^3\text{—}N+(CH_3)_2\text{—}Z\text{—}[Si(CH_3)_2O]_f\text{—}Si(CH_3)_2\text{—}Z\text{—}N+(CH_3)_2\text{—}R^3.2CH_3COO^-$$

wherein a) $z=\text{—}CH_2\text{—}CH(OH)\text{—}CH_2O\text{—}CH_2)_2\text{—}$ b) $R^3$ denotes a long chain alkyl group; and c) f denotes an integer of at least about 2.

In the formulas herein, each definition is applied individually and averages are included.

Another silicone material may include those of the following formula:

$$(CH_3)_3\text{—}Si\text{—}[OSi(CH_3)_2]_n\text{—}\{\text{—}O\text{—}Si(CH_3[(CH_2)_3\text{—}NH\text{—}(CH_2)_2\text{—}NH_2]\}_mOSi(CH_3)_3$$

wherein n and m are the same as before. The preferred silicones of this type are those which do not cause fabric discoloration.

Further non-limiting examples of silicones that are useful in the present invention include silicone polyethers with urethane as disclosed in the U.S. publication of Ser. No. 12/752,860.

In one embodiment, the silicone is an organosiloxane polymer. Non-limiting examples of such silicones include U.S. Pat. Nos: 6,815,069; 7,153,924; 7,321,019; 7,427, 648.

Alternatively, the silicone material can be provided as a moiety or a part of a non-silicone molecule. Examples of such materials are copolymers containing silicone moieties, typically present as block and/or graft copolymers. Further examples of such materials are disclosed in the U.S. Patent Application claiming the benefit of Provisional Application No. 61/320,133 and the U.S. Patent Application claiming the benefit of Provisional Application No. 61/320,141.

Perfumes

One aspect of the invention provides for fabric care compositions comprising a perfume. As used herein the term "perfume" is used to indicate any odoriferous material that is subsequently released into the aqueous bath and/or onto fabrics contacted therewith. The perfume will most often be liquid at ambient temperatures. A wide variety of chemicals are known for perfume uses, including materials such as aldehydes, ketones, and esters. More commonly, naturally occurring plant and animal oils and exudates comprising complex mixtures of various chemical components are known for use as perfumes. The perfumes herein can be relatively simple in their compositions or can comprise highly sophisticated complex mixtures of natural and synthetic chemical components, all chosen to provide any desired odor. Examples of perfumes are described, for example, in US 2005/0202990 A1, from paragraphs 47 to 81. Examples of neat perfumes are disclosed in U.S. Pat. Nos. 5,500,138; 5,500,154; 6,491,728; 5,500,137 and 5,780,404 Perfume fixatives and/or perfume carrier materials may also be included. US 2005/0202990 A1, from paragraphs 82-139. Suitable perfume delivery systems, methods of making certain perfume delivery systems and the uses of such perfume delivery systems are disclosed in USPA 2007/0275866 A1. In one embodiment, the fabric care composition comprises from about 0.01% to about 5%, alternatively from about 0.5% to about 3%, or from about 0.5% to about 2%, or from about 1% to about 2% neat perfume by weight of the fabric care composition.

In one embodiment, the compositions of the present invention comprises perfume oil encapsulated in a perfume microcapsule (PMC), preferable a friable PMC. Suitable perfume microcapsules may include those described in the following references: US 2003-215417 A1; US 2003-216488 A1; US 2003-158344 A1; US 2003-165692 A1; US 2004-071742 A1; US 2004-071746 A1; US 2004-072719 A1; US 2004-072720 A1; EP 1393706 A1; US 2003-203829 A1; US 2003-195133 A1; US 2004-087477 A1; US 2004-0106536 A1; US 2008-0305982 A1; US 2009-0247449 A1; U.S. Pat. No. 6,645,479; U.S. Pat. No. 6,200,949; U.S. Pat. No. 5,145,842; U.S. Pat. No. 4,882,220; U.S. Pat. No. 4,917,920; U.S. Pat. No. 4,514,461; U.S. Pat. No. 4,234,627; U.S. Pat. No. 4,081,384; US RE 32713; U.S. Pat. No. 4,234,627; U.S. Pat. No. 7,119,057. In another embodiment, the perfume microcapsule comprises a friable microcapsule. In another embodiment, the shell comprising an aminoplast copolymer, esp. melamine-formaldehyde or urea-formaldehyde or cross-linked melamine formaldehyde or the like. Capsules may be obtained from Appleton Papers Inc., of Appleton, Wis. USA. Formaldehyde scavengers may also be used.

Dispersants

The compositions may contain from about 0.1%, to about 10%, by weight of dispersants. Suitable water-soluble organic materials are the homo- or co-polymeric acids or their salts, in which the polycarboxylic acid may contain at least two carboxyl radicals separated from each other by not more than two carbon atoms. The dispersants may also be alkoxylated derivatives of polyamines, and/or quaternized derivatives thereof such as those described in U.S. Pat. Nos. 4,597,898, 4,676,921, 4,891,160, 4,659,802 and 4,661,288.

The dispersants may also be materials according to Formula (I):

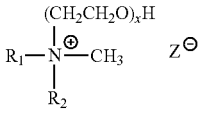

wherein $R_1$ is C6 to C22 alkyl, branched or unbranched, alternatively C12 to C18 alkyl, branched or unbranched. $R_2$ is nil, methyl, or $—(CH_2CH_20)_y$, wherein y is from 2 to 20. When R2 is nil, the Nitrogen will be protonated. x is also from 2 to 20. Z is a suitable anionic counterion, preferably selected from the group consisting of chloride, bromide, methylsulfate, ethylsulfate, sulfate, and nitrate, more preferably chloride or methyl sulfate.

In one embodiment, the dispersant is according to Formula (II):

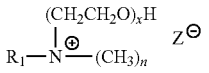

(II)

wherein x is from 2 to 20, and wherein $R_1$ is C6 to C22 alkyl, branched or unbranched, preferably C12 to C18 alkyl, branched or unbranched, and wherein n is 1 or 2. When n is 2, there is an anion. Z is a suitable anionic counterion, preferably selected from the group consisting of chloride, bromide, methylsulfate, ethylsulfate, sulfate, and nitrate, more preferably chloride or methyl sulfate. When n is 1, there is no anion present under acidic conditions. An example of such a material is alkyl polyglycol ether ammonium methylchloride sold under the product name, for example, Berol 648 from Akzo Nobel.

In another embodiment, the dispersant is one according to Formula (III):

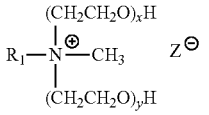

Formula (III)

wherein x and y are each independently selection from 2 to 20, and wherein $R_1$ is C6 to C22 alkyl, branched or unbranched, preferably unbranched. In one embodiment, X+Y is from 2 to 40, preferably from 10 to 20. Z is a suitable anionic counterion, preferably chloride or methyl sulfate. An example of such a material is cocoalkylmethyl ethoxylated ammonium chloride sold under the product name, for example, ETHOQUAD C 25 from Akzo Nobel.

Another aspect of the invention provides for a method of making a perfumed fabric care composition comprising the step of adding the concentrated perfume composition of the present invention to a composition comprising one or more fabric softening actives, wherein preferably the composition comprising the fabric softening active is free or substantially free of a perfume.

The concentrated perfume composition is combined with the composition comprising fabric softening active(s) such that the final fabric softener composition comprises at least 1.5%, alternatively at least 1.7%, or 1.9%, or 2%, or 2.1%, or 2.3%, or 2.5%, or 2.7% or 3%, or from 1.5% to 3.5%, or combinations thereof, of concentrated perfume composition by weight of the final fabric softener composition.

The perfumed fabric care composition comprises a weight ratio of perfume to amphiphile of at least 3 to 1, alternatively 4:1, or 5:1, or 6:1, or 7:1, or 8:1, or 9:1, or 10:1, alternatively not greater than 100:1, respectively.

Structurants

Compositions of the present invention may contain a structurant or structuring agent. Suitable levels of this component are in the range from about 0.01% to 10%, preferably from 0.01% to 5%, and even more preferably from 0.01% to 3% by weight of the composition. The structurant serves to stabilize silicone polymers and perfume microcapsules in the inventive compositions and to prevent it from coagulating and/or creaming. This is especially important when the inventive compositions have fluid form, as in the case of liquid or the gel-form fabric enhancer compositions.

Structurants suitable for use herein can be selected from gums and other similar polysaccharides, for example gellan gum, carrageenan gum, xanthan gum, Diutan gum (ex. CP Kelco) and other known types of structurants such as Rheovis CDE (ex. BASF), Alcogum L-520 (ex. Alco Chemical), and Sepigel 305 (ex. SEPPIC).

One preferred structurant is a crystalline, hydroxyl-containing stabilizing agent, more preferably still, a trihydroxystearin, hydrogenated oil or a derivative thereof.

Without intending to be limited by theory, the crystalline, hydroxyl-containing stabilizing agent is a nonlimiting example of a "thread-like structuring system" ("thread-like structuring systems" are described in detail in Solomon, M. J. and Spicer, P. T., "Microstructural Regimes of Colloidal Rod Suspensions, Gels, and Glasses," Soft Matter (2010)) "Thread-like. Structuring System" as used herein means a system comprising one or more agents that are capable of providing a physical network that reduces the tendency of materials with which they are combined to coalesce and/or phase split. Examples of the one or more agents include crystalline, hydroxyl-containing stabilizing agents and/or hydrogenated jojoba. Surfactants are not included within the definition of the thread-like structuring system. Without wishing to be bound by theory, it is believed that the thread-like structuring system forms a fibrous or entangled thread-like network.

The thread-like structuring system has an average aspect ratio of from 1.5:1, preferably from at least 10:1, to 200:1.

The thread-like structuring system can be made to have a viscosity of 0.002 $m^2/s$ (2,000 centistokes at 20° C.) or less at an intermediate shear range (5 $s^{-1}$ to 50 $s^{-1}$) which allows for the pouring of the fabric enhancer composition out of a standard bottle, while the low shear viscosity of the product at 0.1 $s^{-1}$ can be at least 0.002 $m^2/s$ (2,000 centistokes at 20° C.) but more preferably greater than 0.02 $m^2/s$ (20,000 centistokes at 20° C.). A process for the preparation of a thread-like structuring system is disclosed in WO 02/18528.

Other preferred structurants are uncharged, neutral polysaccharides, gums, celluloses, and polymers like polyvinyl alcohol, polyacrylamides, polyacrylates and co-polymers, and the like.

Dye Transfer Inhibiting Agents

The compositions may also include from about 0.0001%, from about 0.01%, from about 0.05% by weight of the compositions to about 10%, about 2%, or even about 1% by weight of the compositions of one or more dye transfer inhibiting agents such as polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Chelant

The compositions may contain less than about 5%, or from about 0.01% to about 3% of a chelant such as citrates; nitrogen-containing, P-free aminocarboxylates such as ethylenediamine disuccinate (EDDS), ethylenediaminetetraacetic acid (EDTA), and diethylene triamine pentaacetic acid (DTPA); aminophosphonates such as diethylenetriamine pentamethylenephosphonic acid and, ethylenediamine tetramethylenephosphonic acid; nitrogen-free phosphonates e.g., HEDP; and nitrogen or oxygen containing, P-free carboxylate-free chelants such as compounds of the general class of certain macrocyclic N-ligands such as those known for use in bleach catalyst systems.

Other Components

Examples of other suitable components include alkoxylated benzoic acids or salts thereof such as trimethoxy benzoic acid or a salt thereof (TMBA); zwitterionic and/or amphoteric surfactants; enzyme stabilizing systems; coating or encapsulating agent including polyvinylalcohol film or other suitable variations, carboxymethylcellulose, cellulose derivatives, starch, modified starch, sugars, PEG, waxes, or combinations thereof; soil release polymers; suds suppressors; dyes; colorants; salts such as sodium sulfate, calcium chloride, sodium chloride, magnesium chloride; photoactivators; hydrolyzable surfactants; preservatives; anti-oxidants; anti-shrinkage agents; other anti-wrinkle agents; germicides; fungicides; color speckles; colored beads, spheres or extrudates; sunscreens; fluorinated compounds; clays; pearlescent agents; luminescent agents or chemiluminescent agents; anti-corrosion and/or appliance protectant agents; alkalinity sources or other pH adjusting agents; solubilizing agents; processing aids; pigments; free radical scavengers, and combinations thereof. Suitable materials include those disclosed in U.S. Pat. Nos. 5,705,464, 5,710,115, 5,698,504, 5,695,679, 5,686,014 and 5,646,101.

Treating Fabric

The fabric care compositions of the present invention may be used to treat fabric by administering a dose to a laundry washing machine or directly to fabric (e.g., spray). The compositions may be administered to a laundry washing machine during the rinse cycle or at the beginning of the wash cycle, typically during the rinse cycle. The fabric care compositions of the present invention may be used for handwashing as well as for soaking and/or pretreating fabrics. The fabric care composition may be in the form of a powder/granule, a bar, a pastille, foam, flakes, a liquid, a dispersible substrate, or as a coating on a dryer added fabric softener sheet. The composition may be administered to the washing machine as a unit dose or dispensed from a container (e.g., dispensing cap) containing multiple doses. An example of a unit dose is a composition encased in a water soluble polyvinylalcohol film.

Methods of Making

The fabric care compositions of the present disclosure can be formulated into any suitable form and prepared by any process chosen by the formulator, non-limiting examples of which are described in U.S. Pat. Nos. 5,879,584; 5,691,297; 5,574,005; 5,569,645; 5,565,422; 5,516,448; 5,489,392; and 5,486,303.

In one aspect, the compositions disclosed herein may be prepared by combining the components thereof in any convenient order and by mixing, e.g., agitating, the resulting component combination to form a phase stable cleaning composition. In one aspect, a fluid matrix may be formed containing at least a major proportion, or even substantially all, of the fluid components, e.g., nonionic surfactant, the non-surface active liquid carriers and other optional fluid components, with the fluid components being thoroughly admixed by imparting shear agitation to this liquid combination. For example, rapid stirring with a mechanical stirrer may be employed.

EXAMPLES

The following non-limiting examples are illustrative. Percentages are by weight unless otherwise specified. While particular aspects have been illustrated and described, other changes and modifications can be made without departing from the spirit and scope of the invention. It is therefore intended to cover in the appended claims all such changes and modifications that are within the scope of this invention.

Preparation of Glycerol Esters

Example 1

Esterification 200.0 g of Hydrofol 20 fatty acid (available from Evonik Industries), 33.5 g of glycerol and 3.5 g of para-toluenesulfonic acid monohydrate are placed into 500 ml of toluene and refluxed for 16 hours while a stoichiometric amount of liberated water is continuously removed via a Dean-Stark apparatus. Nearly all of the toluene is removed under reduced pressure. About 500 ml of 2-propanol is added to the product and it is mostly removed under reduced pressure to yield an off-white solid at 98% in 2-propanol. Gas chromatography indicates about 1/80/10 monoglyceride/diglyceride/triglyceride weight ratio.

Example 2

Esterification 4000 g of Hydrofol 20 fatty acid (available from Evonik Industries), 670 g of glycerol and 69 g of para-toluenesulfonic acid monohydrate are heated, under reduced pressure to remove water, for 16 hours at 120° C., yielding an off-white solid.

Example 3

Glycerolysis 700.0 g of fully hydrogenated tallow (available from Ed Miniat Inc.), 37.4 g of glycerol and 0.8 g of sodium metal are heated for 16 hours at 130° C. The reaction is cooled to 80° C. and 3 g of acetic acid is added, yielding an off-white solid on cooling. Gas chromatography indicates about 4/55/41 monoglyceride/diglyceride/triglyceride weight ratio.

The following are non-limiting examples of the fabric care compositions of the present invention.

| | II | III | IV | V | VII | VIII | IX |
|---|---|---|---|---|---|---|---|
| FSA[a] | 5 | 5 | 6.8 | 5 | 4.5 | 6.7 | 6.7 |
| GDE[b] | 10 | 0 | 8.2 | 6 | 5.6 | 8.4 | 0 |
| GDE[c] | 0 | 10 | 0 | 0 | 0 | 0 | 8.4 |
| CTMAC[d] | 3 | 3 | 0 | 0 | 0 | 0 | 0 |
| Tergitol TMN-6 | 2 | 2 | 0 | 0 | 0 | 0 | 0 |
| $CaCl_2$ | 0.15 | 0.15 | 0 | 0 | 0.1 | 0 | 0 |
| NaCl | 0 | 0 | 0.15 | 0.15 | 0 | 0.30 | 0.30 |
| Depo Aid[e] | 0.25 | 0.25 | 0.25 | 0.80 | 0 | 0 | 0 |
| Anti-foam[f] | 0.15 | 0.15 | 0.15 | 0.15 | 0 | 0 | 0 |
| Chelant[g] | 0.05 | 0.05 | 0.05 | 0.05 | 0 | 0 | 0 |
| Perfume | 2 | 2 | 2 | 2 | 0 | 0 | 0 |
| PMC[h] | 0.35 | 0.35 | 0.35 | 0.35 | 0 | 0 | 0 |

[a]N,N-di(tallowoyloxyethyl)-N,N-dimethylammonium chloride.
[b]GDE from Example 3.
[c]GDE from Example 1.
[d]CTMAC = cetyl trimethylammonium chloride
[e]Poly(ethylene imine) Epomin P1050 (ex Nippon Shokubai)
[f]Silicone antifoam agent available from Dow Corning ® under the trade name DC2310.
[g]Diethylenetriamine pentaacetic acid
[h]Perfume microcapsules available ex Appleton

| (% wt) | X | XI | XII | XIII | XIV | XV | XVI | XVII | XVIII |
|---|---|---|---|---|---|---|---|---|---|
| FSA[a] | 3.8 | 3.8 | 4.6 | 5.3 | 6.3 | 6 | 6.3 | — | — |
| FSA[b] | — | — | — | — | — | — | — | 4.8 | — |
| FSA[c] | — | — | — | — | — | — | — | — | 5.9 |
| GDE[d] | 4.9 | — | 3.4 | 4.7 | 5.7 | 8.3 | 12.7 | 5.8 | 7.1 |
| GDE[e] | — | 4.9 | — | — | — | — | — | — | — |
| Structurant[f,g] | — | — | 1.2 | — | — | 0.2[g] | — | 0.2[g] | 0.2[g] |
| Perfume | 1.5 | 1.5 | 2.0 | 2.0 | 2.0 | 2.0 | 2.0 | 4 | 2.0 |
| Perfume encapsulation[h] | 0.6 | 0.6 | 0.3 | 0.3 | 0.3 | 0.4 | — | — | 0.15 |
| Phase Stabilizing Polymer[i] | 0.25 | 0.25 | — | — | — | — | 0.142 | 1 | 0.25 |
| Suds Suppressor[j] | — | — | — | 0.1 | — | — | — | 0.1 | — |
| Sodium Chloride | 0.15 | 0.15 | 0.15 | — | — | 0.6 | 0.6 | — | 0.15 |
| Calcium Chloride(ppm) | — | — | — | 200 | 175 | — | — | 750 | — |
| DTPA[k] | 0.005 | 0.005 | 0.005 | 0.005 | 0.005 | 0.005 | 0.005 | 0.005 | 0.005 |
| Preservative (ppm)[l] | 5 | 5 | 5 | 5 | 5 | 5 | 5 | 5 | 5 |
| Antifoam[m] | 0.015 | 0.015 | 0.15 | 0.15 | 0.15 | 0.11 | 0.011 | 0.015 | 0.011 |
| Polyethylene imines[n] | 0.15 | 0.15 | 0.25 | 0.15 | 0.15 | — | 0.1 | 0.15 | — |
| Cationic methacrylate acrylamide copolymer[o] | — | — | — | 0.15 | 0.25 | — | — | 0.15 | — |

-continued

| | | | | | | | | | |
|---|---|---|---|---|---|---|---|---|---|
| Cationic acrylate acrylamide copolymer[p] | 0.25 | 0.25 | — | — | — | 0.2 | 0.05 | — | 0.1 |
| PDMS emulsion[q] | — | — | — | 3 | — | 1 | 2.0 | — | — |
| Dispersant[r] | — | — | — | — | — | 0.5 | 0.2 | — | 0.2 |
| Organosiloxane polymer[s] | 3 | 3 | — | — | — | — | — | — | — |
| Amino-functional silicone | — | — | 5 | — | — | — | — | — | 5 |
| Dye ((ppm) | 40 | 40 | 11 | — | — | 30 | 40 | 40 | 40 |
| Ammonium Chloride | — | — | — | — | — | — | 0.10 | 0.10 | — |
| Hydrochloric Acid | 0.010 | 0.010 | 0.01 | 0.01 | 0.01 | 0.10 | 0.010 | 0.010 | 0.010 |
| Deionized Water | Balance | Balance | Balance | Balance | Balance | Balance | Balance | Balance | Balance |

[a]N,N-di(tallowoyloxyethyl)-N,N-dimethylammonium chloride.
[b]Reaction product of fatty acid with methyldiethanolamine in a molar ratio 1.5:1, quaternized with methylchloride, resulting in a 1:1 molar mixture of N,N-bis(stearoyl-oxy-ethyl) N,N-dimethyl ammonium chloride and N-(stearoyl-oxy-ethyl) N,-hydroxyethyl N,N dimethyl ammonium chloride.
[c]The reaction product of fatty acid with an iodine value of 20 with methyl/diisopropylamine in a molar ratio from about 1.86 to 2.1 fatty acid to amine and quaternized with methyl sulfate.
[d]GDE from Example 3.
[e]GDE from Example 1.
[f]Cationic high amylose maize starch available from National Starch under the trade name HYLON VII ®.
[g]Cationic polymer available from Ciba ® under the name Rheovis ® CDE.
[h]Perfume microcapsules available ex Appleton
[i]Copolymer of ethylene oxide and terephthalate having the formula described in U.S. Pat. No. 5,574,179 at col.15, lines 1-5, wherein each X is methyl, each n is 40, u is 4, each R1 is essentially 1,4-phenylene moieties, each R2 is essentially ethylene, 1,2-propylene moieties, or mixtures thereof.
[j]SILFOAM ® SE 39 from Wacker Chemie AG.
[k]Diethylene triamine pentaacetic acid.
[l]Koralone ™ B-119 available from Dow.
[m]Silicone antifoam agent available from Dow Corning ® under the trade name DC2310.
[n]Polyethylene imines available from BASF under the trade name Lupasol ® or from Nippon Shokubai under the tradename Epomin ®
[o]Sedipur CL 541 or Sedipur CL544 from BASF
[p]Cationic acrylate acrylamide copolymer as described on page 25-26.
[q]Polydimethylsiloxane emulsion from Dow Corning ® under the trade name DC346.
[r]Non-ionic surfactant, such as TWEEN 20 ™ or TAE80 (tallow ethoxylated alcohol, with average degree of ethoxylation of 80), or cationic surfactant as Berol 648 and Ethoquad ® C 25 from Akzo Nobel.
[s]Organosiloxane polymer condensate made by reacting hexamethylenediisocyanate (HDI), and a, w silicone diol and 1,3-propanediamine, N'-(3-(dimethylamino)propyl)-N,N-dimethyl-Jeffcat Z130) or N-(3-dimethylaminopropyl)-N,Ndiisopropanolamine (Jeffcat ZR50) commercially available from Wacker Silicones, Munich, Germany.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fabric care composition comprising:

a. from about 4% to about 30%, by weight of the fabric care composition, of a mixture of glycerides, each having the structure of Formula I (Formula I)

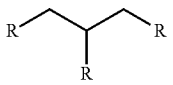

wherein each R is independently selected from the group consisting of fatty acid ester moieties comprising carbon chains having a carbon chain length of from about 10 to about 22 carbon atoms; —OH; and combinations thereof;

wherein the mixture of glycerides contains diglycerides, monoglycerides, and triglycerides in a weight ratio of about 4:6 to about 99.9:0.1 diglycerides to mono- and triglycerides; and b. from about 0.01% to about 10% by weight of the fabric care composition of a delivery enhancing agent, said delivery enhancing agent comprising a polymer having a net cationic charge c. a fabric softener active being selected from the group consisting of:

(i) bis-(2-hydroxyethyl)-dimethylammonium chloride fatty acid ester having an average chain length of the fatty acid moieties of from 16 to 20 carbon atoms;

(ii) bis-(2-hydroxypropyl)-dimethylammonium methylsulphate fatty acid ester having a molar ratio of fatty acid moieties to amine moieties of from 1.85 to 1.99, an average chain length of the fatty acid moieties of from 16 to 18 carbon atoms and an iodine value of the fatty acid moieties, calculated for the free fatty acid, of from 0.5 to 60;

(iii) N,N-bis(stearoyl-oxy-ethyl)N,N-dimethyl ammonium chloride;

(iv) N,N-bis(tallowoyl-oxy-ethyl)N,N-dimethyl ammonium chloride;

(v) N,N-bis(stearoyl-oxy-ethyl)N-(2 hydroxyethyl)N-methyl ammonium methylsulfate;

(vi) dicanoladimethylammonium chloride;

(vii) di(hard)tallowedimethylammonium chloride;

(viii) dicanoladimethylammonium methylsulfate; and (ix) mixtures thereof.

2. The composition of claim 1 wherein the delivery enhancing agent is an enzyme-compatible delivery enhancing agent.

3. The composition of claim 1 wherein the ratio of diglycerides to monoglycerides is from about 4:6 to about 8:2.

4. The fabric care composition of claim 1 further comprising from about 1.5% to about 50% of fabric softening active.

5. The fabric care composition of claim 4 wherein the fabric softening active is bis-(2 hydroxyethyl)-dimethylammonium chloride fatty acid ester having an average chain length of the fatty acid moieties of from 16 to 20 carbon atoms and an Iodine Value (IV), calculated for the free fatty acid, of from 15 to 25.

6. The fabric care composition of claim 1 comprising from about 4% to about 20%, by weight of the fabric care composition, of the mixture of glycerides.

7. The fabric care composition of claim 1 comprising from about 4% to about 10%, by weight of the fabric care composition, of the mixture of glycerides.

8. The fabric care composition of claim 1 comprising from about 5% to about 8%, by weight of the fabric care composition, of the mixture of glycerides.

9. The fabric care composition of claim 1 wherein the mixture of glycerides contains diglycerides and monoglycerides in a weight ratio of about 6:4 to about 8:2.

10. The fabric care composition of claim 9 wherein said delivery enhancing agent is a cationic polymer having a weight-average molecular weight of from about 1500 to about 10,000,000.

11. The fabric care composition of claim 1 wherein the delivery enhancing agent is a cationic polymer with a net cationic charge density of from about 0.05 meq/g to about 23 meq/g.

12. The fabric care composition of claim 11 wherein said delivery enhancing agent is selected from cationic acrylic based homopolymers, poly(acrylamide-N-dimethyl aminoethyl acrylate) and its quaternized derivatives, poly(acrylamide-N-dimethyl aminoethyl methacrylate) and its quaternized derivatives, polyethyleneimine, or mixtures thereof.

13. The fabric care composition of claim 1 further comprising from about 0.5% to about 3.0% of neat perfume by weight of the fabric care composition.

14. The fabric care composition of claim 1 further comprising a perfume microcapsule.

15. The fabric care composition of claim 1, wherein the pH of the composition is from about 2 to about 5.

16. The fabric care composition of claim 1 further comprising from about 0.25% to about 5% by weight of the fabric care composition of a silicone, preferably wherein the silicone is a polydimethylsiloxane or an organosiloxane polymer.

17. A method of providing a benefit to a fabric comprising contacting the fabric with the fabric care composition of claim 1.

18. A method of making a fabric care composition comprising the steps of:

a. combining water with a mixture of glycerides and a fabric softener active to form a first mixture, wherein each glyceride has the structure of Formula I

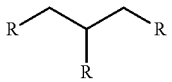

(Formula I)

wherein each R is independently selected from the group consisting of fatty acid ester moieties comprising carbon chains having a carbon chain length of from about 10 to about 22 carbon atoms; —OH; and combinations thereof;

wherein the mixture of glycerides contains diglycerides, monoglycerides, and triglycerides in a weight ratio of about 4:6 to about 99.9:0.1 diglycerides to mono- and triglycerides; and said fabric softener active is selected from the group consisting of:

(i) bis-(2-hydroxyethyl)-dimethylammonium chloride fatty acid ester having an average chain length of the fatty acid moieties of from 16 to 20 carbon atoms;

(ii) bis-(2-hydroxypropyl)-dimethylammonium methylsulphate fatty acid ester having a molar ratio of fatty acid moieties to amine moieties of from 1.85 to 1.99, an average chain length of the fatty acid moieties of from 16 to 18 carbon atoms and an iodine value of the fatty acid moieties, calculated for the free fatty acid, of from 0.5 to 60;

(iii) N,N-bis(stearoyl-oxy-ethyl)N,N-dimethyl ammonium chloride;

(iv) N,N-bis(tallowoyl-oxy-ethyl)N,N-dimethyl ammonium chloride;

(v) N,N-bis(stearoyl-oxy-ethyl)N-(2 hydroxyethyl)N-methyl ammonium methylsulfate;

(vi) dicanoladimethylammonium chloride;

(vii) di(hard)tallowedimethylammonium chloride;

(viii) dicanoladimethylammonium methylsulfate; and (ix) mixtures thereof;

b. combining the first mixture with a delivery enhancing agent comprising a polymer having a net cationic charge and a material selected from an antifoam agent, a chelant, a preservative, a structurant, a silicone, a phase stabilizing polymer, a perfume, a perfume microcapsule, a dispersant, or a combination thereof to form the fabric care composition.

* * * * *